US005933890A

United States Patent [19]

Codd

[11] Patent Number: 5,933,890

[45] Date of Patent: Aug. 10, 1999

[54] THERAPEUTIC PILLOW

[76] Inventor: Gerard Cyril Codd, 7 Arboretum View, Lincoln, United Kingdom, LN2 5JQ

[21] Appl. No.: 08/836,836

[22] PCT Filed: Sep. 6, 1996

[86] PCT No.: PCT/GB96/02213

§ 371 Date: Jun. 25, 1997

§ 102(e) Date: Jun. 25, 1997

[87] PCT Pub. No.: WO97/08978

PCT Pub. Date: Mar. 13, 1997

[30] Foreign Application Priority Data

Sep. 6, 1996 [GB] United Kingdom ..... 9518425.5

[51] Int. Cl.[6] ..... A47C 20/02

[52] U.S. Cl. ..... 5/636; 5/630; 5/637; 5/643; 5/645

[58] Field of Search ..... 5/636, 643, 644, 5/645, 638, 637, 622, 630; 297/391

[56] References Cited

U.S. PATENT DOCUMENTS

| | | | |
|---|---|---|---|
| 8,065 | 4/1851 | Towers | 248/118.5 |
| Re. 17,607 | 2/1930 | Lange | 5/645 |
| 247,892 | 10/1881 | Doremus | 5/640 |
| 3,416,169 | 12/1968 | Emery | 5/349 |
| 4,688,285 | 8/1987 | Roberts | 5/468 |
| 5,437,070 | 8/1995 | Rempp | 5/636 |

FOREIGN PATENT DOCUMENTS

| | | |
|---|---|---|
| 2071105 | 9/1971 | France . |
| 682271 | 10/1939 | Germany . |

*Primary Examiner*—Michael F. Trettel
*Assistant Examiner*—Fredrick Conley
*Attorney, Agent, or Firm*—Baker & Daniels

[57] ABSTRACT

A therapeutic pillow for inducing a state of physiological relaxation. The pillow is formed from a substantially shaped sustaining material and comprises an upwardly facing concave supporting surface formed by four component surfaces which are separated by a cruciform shaped recess.

10 Claims, 2 Drawing Sheets

THERAPEUTIC PILLOW

This application is a 371 of PCT/GB96/02213 filed Sept. 6, 1996.

According to the present invention a therapeutic pillow, for inducing a state of physiological relaxation, is formed from a substantially shape sustaining material and comprises an upwardly facing concave supporting surface formed by four component surfaces which are separated by a cruciform shaped recess.

When a patient lies with his head on the supporting surface of the pillow the cruciform shaped recess permits some relative movement between the four component surfaces to accommodate craniosacral movement of the occiput bone at the back of the skull and its attendant membranes and muscles to induce a state of physiological relaxation.

Four component surfaces are used to correspond to the structure at the rear of the scull to provide greatest relaxation.

The base of the pillow may comprise a two dimensional or three dimensional downwardly facing convex surface to act as a rocker to allow movement of the occiput bone in craniosacral motion and the head as a whole in movement produced by the act of respiration.

In its simplest form, the pillow may comprise a block of material with a concave upwardly facing surface and a cruciform shaped recess formed therein. However, preferably the pillow comprises a rigid base, with four softer pads projecting therefrom to provide the component surfaces. The base may be of any suitable material such as wood, sprung steel or plastics, such as polyurethane or polystyrene weighted with a heavier material such as lead. The pads may be foam such as integrated polyurethane with a density of 70–90, or may be hollow and filled with pressurised air. The pads may have a cover of soft material or fabric such as leather. Each pad preferably has a Shore A scale hardness value of between 15 and 80, and more preferably between 35 and 40.

Preferably each of the component surfaces extends radially outwardly from the centre of the cruciform shaped recess and is convex in this direction, and at least the portion of each surface closest to the centre of the recess is concave in the circumferential direction of a circle centered on the centre of the recess.

Figure 1:
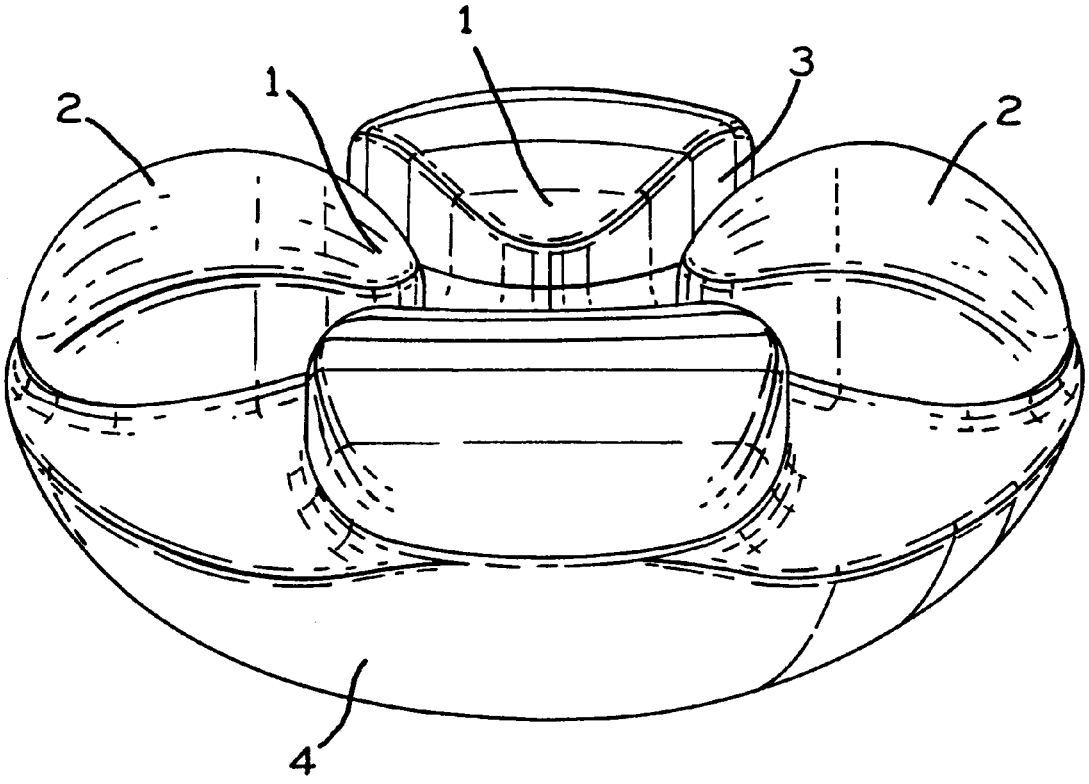
FIG. 1 is a perspective view of a pillow in accordance with the present invention.
Figure 2:
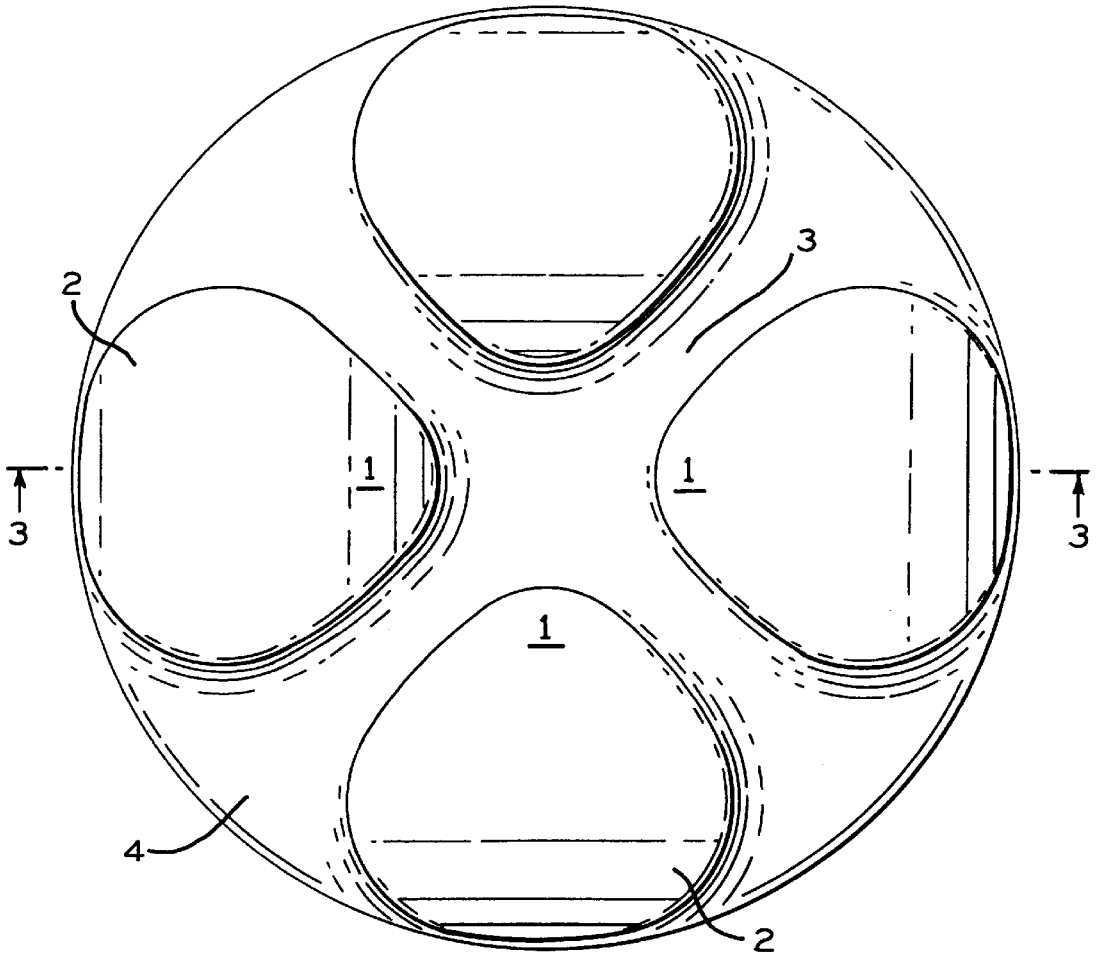
FIG. 2 is a plan of the pillow shown in FIG. 1.
Figure 3:
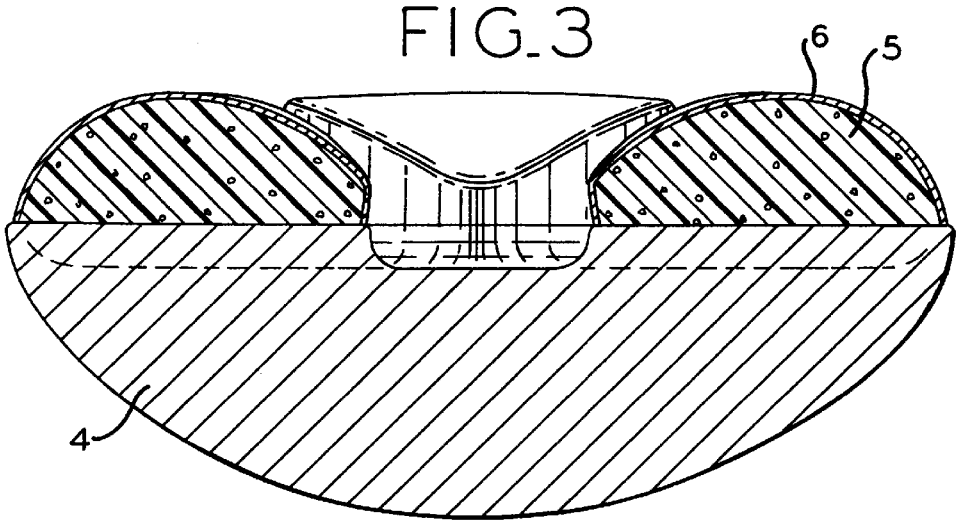
FIG. 3 is a section taken along lines III—III in FIG. 2.

The therapeutic pillow shown in FIGS. 1 to 3 has an upwardly facing concave supporting surface 1 formed from four substantially quadrant shaped component surfaces 2 which are separated by a cruciform shaped recess 3. The pillow comprises a base 4 with a downwardly facing convex surface so that the pillow may rock to and fro or from side to side. The surfaces 2 are provided by four foam pads 5 fixed to the upper surface of the base 4. The pads 5 are covered with leather 6. The surfaces 2 are convex in a radial direction as shown in FIG. 3, and, towards the centre of the recess 3, concave in a circumferential direction.

In use a patient adopts a 'Crook Lying' position, lying on his back with the back of his head resting on the supporting surface 1 of the pillow and with his hips and knees bent to a comfortable degree and supported by conventional pillows.

I claim:

1. A therapeutic pillow for inducing a state of physiological relaxation comprising a substantially rigid base portion and an upwardly facing concave supporting surface formed by four component surfaces which are separated by a cruciform shaped recess; said four component surfaces being formed by four pads projecting from said base being of a material that is softer than said base and is substantially shape sustaining relative to pressure exerted by the weight of a user's head.

2. A pillow according to claim 1, wherein each pad has a Shore A scale hardness value of between 15 and 80.

3. A pillow according to claim 2, wherein each pad has a Shore A scale hardness value of between 35 and 40.

4. A pillow according to claim 1, wherein the base portion comprises a two dimensional or three dimensional downwardly facing convex surface to act as a rocker.

5. A pillow according to claim 1, wherein each of the pads extends radially outwardly from a centre of the cruciform shaped recess and is convex in this direction, and at least that portion of each pad closest to the centre of the recess is concave in the circumferential direction of a circle centered on the centre of the recess.

6. A pillow according to claim 2, wherein the base portion comprises a two dimensional or three dimensional downwardly facing convex surface to act as a rocker.

7. A pillow according to claim 3, wherein the base portion comprises a two dimensional or three dimensional downwardly facing convex surface to act as a rocker.

8. A pillow according to claim 2, wherein each of the pads extends radially outwardly from a center of the cruciform shaped recess and is convex in this direction, and at least that portion of each pad closest to the center of the recess is concave in the circumferential direction of a circle centered on the center of the recess.

9. A pillow according to claim 3, wherein each of the pads extends radially outwardly from a center of the cruciform shaped recess and is convex in this direction, and at least that portion of each pad closest to the center of the recess is concave in the circumferential direction of a circle centered on the center of the recess.

10. A pillow according to claim 4, wherein each of the component surfaces extends radially outwardly from a center of the cruciform shaped recess and is convex in this direction, and at least that portion of each pad closest to the center of the recess is concave in the circumferential direction of a circle centered on the center of the recess.

* * * * *